US010338516B2

(12) United States Patent
Moalem et al.

(10) Patent No.: US 10,338,516 B2
(45) Date of Patent: Jul. 2, 2019

(54) PHOTOCONDUCTOR REFRESHING CYCLES

(71) Applicant: HP Indigo B.V., Amstelveen (NL)

(72) Inventors: Sasi Moalem, Ness Ziona (IL); Dmitry Maister, Ness Ziona (IL); Seongsik Chang, Palo Alto, CA (US); Dekel Green, Palo Alto, CA (US)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 15/749,058

(22) PCT Filed: Dec. 22, 2015

(86) PCT No.: PCT/US2015/067410
§ 371 (c)(1),
(2) Date: Jan. 30, 2018

(87) PCT Pub. No.: WO2017/111948
PCT Pub. Date: Jun. 29, 2017

(65) Prior Publication Data

US 2018/0224798 A1 Aug. 9, 2018

(51) Int. Cl.

| | |
|---|---|
| ***G03G 15/00*** | (2006.01) |
| ***G03G 21/00*** | (2006.01) |
| ***G03G 15/02*** | (2006.01) |

(52) U.S. Cl.
CPC ..... *G03G 21/0094* (2013.01); *G03G 15/0266* (2013.01); *G03G 21/0023* (2013.01); *G03G 21/0076* (2013.01)

(58) Field of Classification Search
USPC ..... 399/26, 89, 94, 128, 296
See application file for complete search history.

(56) References Cited

U.S. PATENT DOCUMENTS

| | | | |
|---|---|---|---|
| 5,164,773 | A | 11/1992 | Nishio et al. |
| 5,923,933 | A | 7/1999 | Anzai et al. |
| 6,156,466 | A | 12/2000 | Tamura et al. |

(Continued)

FOREIGN PATENT DOCUMENTS

WO WO-2014-206497 A1 12/2014

OTHER PUBLICATIONS

Tokarski, Z. et al., "Investigations of Charge Migration and Charge Trapping in Fatigued Organic Photoconductors", Proceedings for Society for Imaging Science and Technology Mar. 26, 2013.

*Primary Examiner* — Hoan H Tran
(74) *Attorney, Agent, or Firm* — Perry + Currier Inc

(57) ABSTRACT

Examples of refreshing a photoconductive layer in an image forming apparatus are described. In one example, a method includes performing a first refreshing cycle comprising applying, at a first refresh unit, a first refresh voltage to the photoconductive layer and applying, at a second refresh unit, a second refresh voltage to the photoconductive layer. A second refreshing cycle is performed including applying, at the first refresh unit, a third refresh voltage to the photoconductive layer, the third refresh voltage being higher than the first refresh voltage and higher than the second refresh voltage. Each of the first and second refreshing cycles electrically bias the photoconductive layer to a refresh polarity opposite to a print polarity applied during a print routine of the image forming apparatus.

15 Claims, 6 Drawing Sheets

(56) References Cited

U.S. PATENT DOCUMENTS

| | | | | |
|---|---|---|---|---|
| 6,223,011 | B1 | 4/2001 | Abramsohn et al. | |
| 6,381,424 | B1 | 4/2002 | Takahashi et al. | |
| 8,682,231 | B2 * | 3/2014 | Sengoku | G03G 15/161 399/296 |
| 9,042,747 | B2 * | 5/2015 | Takeuchi | G03G 15/556 399/27 |
| 9,316,932 | B2 * | 4/2016 | Nonaka | G03G 5/0672 |
| 2008/0019737 | A1 | 1/2008 | Kabata et al. | |
| 2010/0080585 | A1 | 4/2010 | Booth et al. | |
| 2011/0286752 | A1 | 11/2011 | Burry et al. | |
| 2012/0308262 | A1 | 12/2012 | Gamzon-Kapeller et al. | |
| 2013/0308982 | A1 | 11/2013 | Gila et al. | |
| 2013/0322902 | A1 | 12/2013 | Miyahara | |

* cited by examiner

PHOTOCONDUCTOR REFRESHING CYCLES

BACKGROUND

Electrophotography is commonly used in digital printers or presses. Digital printing may use a variety of print material to reproduce a variety of digital sources on a variety of media. Digital printers or presses may utilize a photoconductor to apply print material to a print medium. The photoconductor may be charged and exposed to light. Charged print material, such as toner, may be attracted to areas of the photoconductor. The print material may be transferred to from the photoconductor to the print medium directly or to an offset unit. Heat and/or pressure may fuse the toner to the medium.

BRIEF DESCRIPTION OF THE DRAWINGS

Various features of the present disclosure will be apparent from the detailed description which follows, taken in conjunction with the accompanying drawings, which together illustrate, features of certain examples, and wherein.

DETAILED DESCRIPTION

In the following description and figures, some example implementations of an image forming apparatus, systems, and/or methods are described. An image forming apparatus using electrophotography may generate a constant or intermittent charge on a photoconductor during a print routine, or print cycle. After completing a number of print cycles over a time period, the photoconductor may obtain characteristics that decrease print quality. For example, the photoconductor may become ionized, may change in molecular structure, may trap charges, and/or may show signs of lateral conductivity. These contamination effects may make it difficult to accurately affix print material to a print article or medium. The print medium may include an intermediate transfer member. Print quality may be improved by maintaining the photoconductor with a routine that may lessen effects of contamination. Although mechanical polish may be used to remove contamination, this does not fully eliminate photoconductor degradation. Use of mechanical polish also typically incurs an associated hardware cost, such as consumable polishing rollers, and reduces press utilization. The limited lifetime of a photoconductor typically may contribute to the cost per printed pages of an image forming apparatus. It is thus desirable to maximise photoconductor lifetime.

Various examples described below were developed to lessen the effects of repeated charging and light-induceddischarging of a photoconductor. Damage to and contamination of the top layer of a photoconductor causes charges to become trapped within that layer. By scheduling time to refresh the photoconductor by charging the photoconductive layer of the photoconductive unit to a polarity opposite of the polarity of the photoconductive layer during a print cycle, the trapped charges can be removed and print quality can be recovered.

Figure 1A:
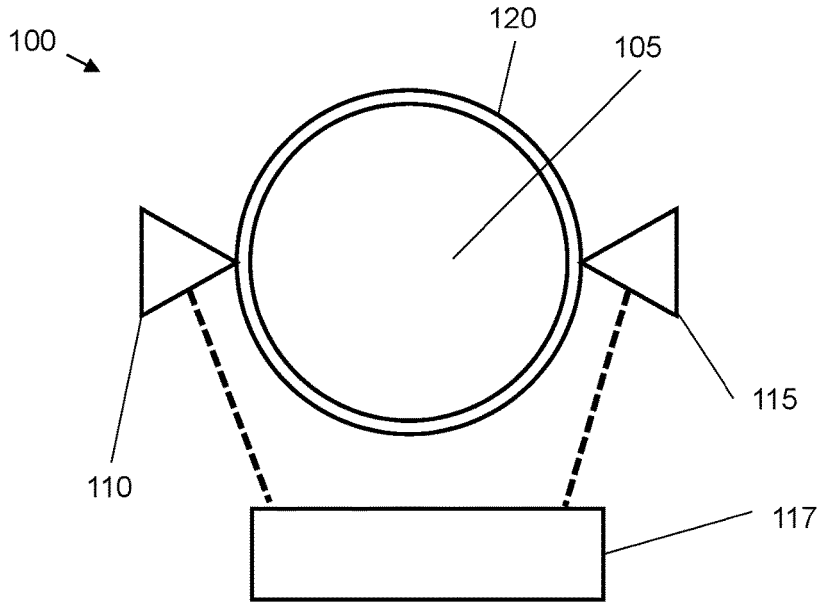
FIGS. 1A and 1B are schematic diagrams showing image forming devices according to examples.

FIG. 1A is a schematic representation of an image forming apparatus 100 according to examples. In these examples, the image forming apparatus 100 includes a photoconductive unit 105 comprising a photoconductive layer 120, a first refresh unit 110, a second refresh unit 115 and a controller 117. In examples, at least one of the first 110 and second 115 refresh units is not a dedicated unit for performing refreshing cycles. In one example in which the first charging 110 unit is a charge roller and the second refresh unit 115 is an intermediate transfer unit, both refresh units are also used during a print cycle of the image forming apparatus 100. The photoconductive unit 105 may typically be a photoconductive drum, although in other examples may have a different form, such as a belt, or other transfer member. The photoconductive layer 120 may be an organic photoconductor, for example with a bi-layer structure comprising a charge generation layer and a charge transfer layer.

In certain examples, the photoconductive layer 120 is configured to apply a print material to a print article. In certain examples, the print material is directly applied to the print article or indirectly applied by using for example an offset unit for transferring the print material. In certain examples, an offset unit comprises an intermediate transfer member capable of transferring the print material from the photoconductive unit 105 to the print article. In certain examples, at least one of the first and second refresh units 110, 115 is configured to, during a print routine, electrically bias the photoconductive layer to a print polarity, for example during a print routine while the image forming apparatus 100 is in a print mode. In certain examples, the photoconductive layer 120 is capable of being electrically biased to have a refresh polarity during one or more refreshing cycles. The refresh polarity is a polarity used during a refreshing cycle. In certain examples, the refreshing cycles are non-print routines which occur when the image forming apparatus 100 is not in a print mode. In certain examples, the image forming apparatus 100 is operable in various modes, for example a refresh mode, an idle mode or a print mode.

In an example, the first refresh unit 110 is controllable by the controller 117 to, during a first refreshing cycle, apply a first refresh voltage to the photoconductive layer. The second refresh unit 115 is controllable by the controller 117 to, during the first refreshing cycle, apply a second refresh voltage to the photoconductive layer. In certain examples, during the first and second refreshing cycles, each of the first and second refresh units 110, 115 is controllable by the controller 117 to electrically bias the photoconductive layer to a refresh polarity opposite to the print polarity. In certain examples, the print polarity is negative and the refresh polarity is positive. In other examples, the voltage is supplied by direct current, alternating current, pulsating current, variable current, or a combination of currents. "Voltage" such as voltage 113, may be discussed as a "first/second refresh voltage" or in conjunction with another modifier to denote the source of the voltage, but may otherwise have the same characteristics of other voltages described herein.

In an example, the first refresh unit 110 is controllable by the controller 117 to, during a second refreshing cycle, apply a third refresh voltage to the photoconductive layer 120; in such examples, the third refresh voltage is higher than the first refresh voltage and higher than the second refresh voltage. In certain examples, during this second refreshing cycle, the first refresh unit is controllable by the controller 117 to electrically bias the photoconductive layer to the refresh polarity.

In certain examples, the first, second and third refresh voltages achieve an avalanche threshold. The avalanche threshold may represent the strength of the electric field, or potential gradient, to form a conductive region around the conductor. In particular, the avalanche threshold may be based on a function defining a point at which the gas or fluid around the conductor ionizes to form an electron avalanche. The gas or fluid around the conductor may be air.

One example of a charge that may produce an electron avalanche is a corona charge. A corona charge may have an electric field with the strength sufficient to ionize a neutral atom where the energy of electric field may accelerate oppositely charged particles in opposite directions at a velocity high enough to collide with and ionize another atom. This may repeat until a certain distance is reached where the electric field strength may be low enough to no longer provide sufficient energy to continue ionizing more atoms.

The avalanche threshold may be based on the distance between two surfaces, or gap length. For example, the avalanche threshold may be determined based on a function of an electric field strength and a gap length between the photoconductive layer and a charge surface; the charge surface may be part of charge mechanism that may apply the refresh voltage to the photoconductive layer. The electric field may become low enough at a distance from the conductor that the electric field may not provide enough energy to ionize the air at that distance. For example, a 1000 volt charge may achieve the avalanche threshold in air over a gap length of 0.1 mm, but may not achieve the avalanche threshold in air over a gap length of 1 mm.

A voltage at or above the threshold based on the gap length may be used for refreshing the photoconductive layer 106. For example, if an avalanche threshold is 600 volts, the avalanche threshold may be achieved by meeting the threshold by applying 600 volts or by surpassing the threshold by applying more than 600 volts. The avalanche threshold may be based on corona charging, Paschen's law, or other studies or experiments providing a minimum voltage to apply between two surfaces to form an electron avalanche.

In certain examples, either or both of the refresh units 110, 115 comprise units dedicated to providing a charge to the photoconductive layer 120 during the refresh routine. In certain examples, either or both of the refresh units 110, 115 comprise a charge roller and/or an intermediate unit. In certain examples, an intermediate unit comprises any chargeable component of an image forming apparatus capable of transferring a charge to the photoconductive layer 120 to electrically bias the photoconductive layer 120. In examples, an intermediate unit comprises at least one of a development unit, a transfer unit or intermediate transfer drum, an offset unit, a sponge unit, and a conductive layer of the photoconductive unit 105. In other examples, either or both of the refresh units 110, 115 comprise a developer roller without ink circulation and/or a cleaning station roller capable of applying voltage.

Figure 1B:
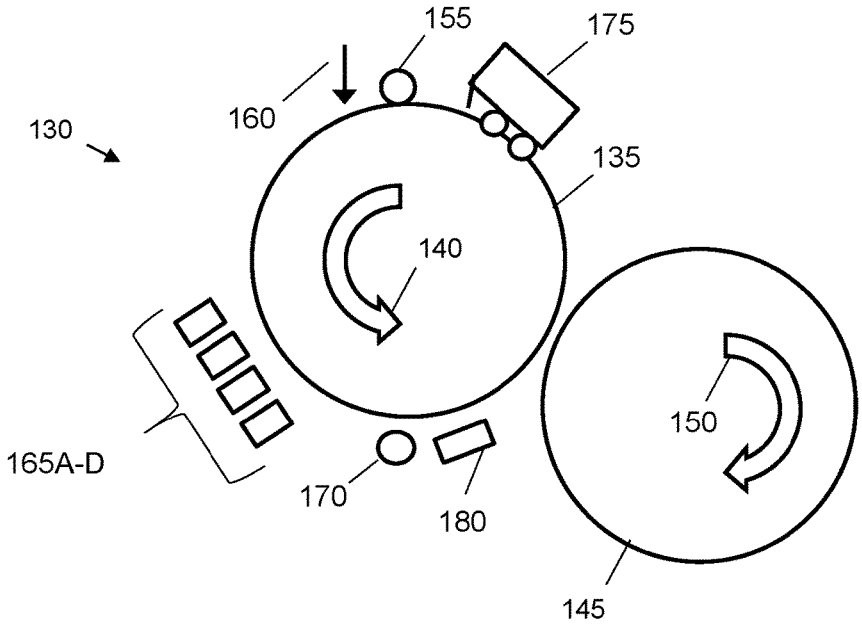

FIG. 1B is a more detailed schematic diagram showing a liquid electrophotographic printer 130 in accordance with an example.

Printer 130 comprises a photo imaging plate 135, which, in use, rotates in the direction indicated by arrow 140 and a heated blanket 145, which, in use, rotates in the direction indicated by arrow 150. The printer 130 further comprises a photo charging unit 155 and one or more lasers 160. The printer 130 further comprises a plurality of image development units 165A-D, as well as a roller 170. In some examples, the printer also comprises a cleaning station 175 and a pre-transfer erase unit 180.

In some examples, the pre-transfer erase unit 180 comprises a set of diodes to illuminate the photo imaging plate 135. Illumination causes a homogeneous conductivity across the photo imaging plate 135 leading to dissipation of the charges still existing on the background. This enables a clean transfer of the image in the next stage avoiding the background charges from sparking to the heated blanket 145 and damaging the image and, in time, the photo imaging plate 135 and the heated blanket 145.

The cleaning station 175 is used to remove residual ink on the photo imaging plate 135 after the second transfer has taken place. In some examples, the cleaning station 175 also cools the photo imaging plate 135 from heat transferred during contact with the heated blanket 145. The photo imaging plate 135 is then ready to be recharged by the charging unit 155 ready for the next image.

Figure 2A:
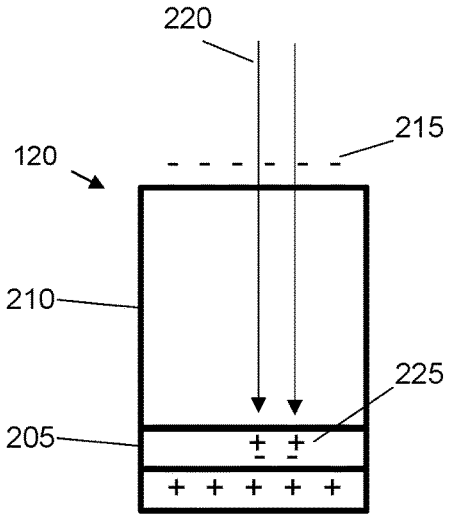
FIGS. 2A-2E illustrate charge dynamics in a photoconductive layer during example print and refresh routines.
Figure 2B:
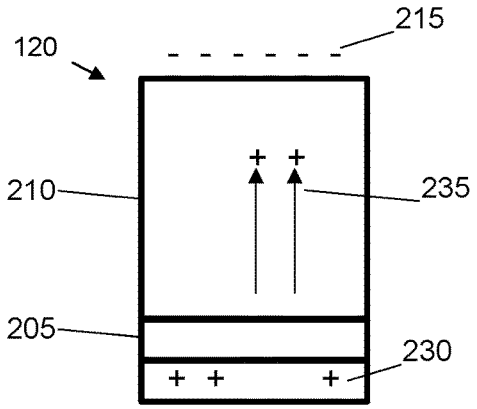
Figure 2C:
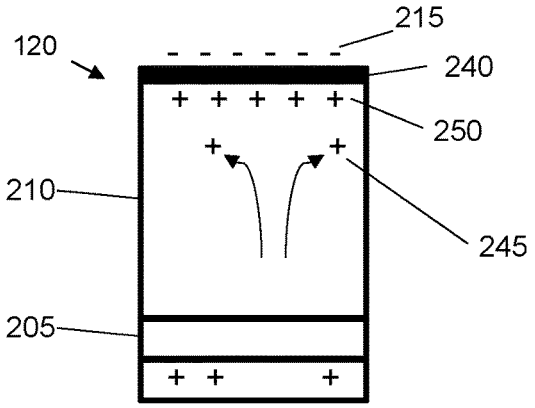

FIGS. 2A-2C illustrate charge dynamics in the photoconductive layer 120 during a print routine. Although examples of positive and negative charges are used, it will be appreciated that the description applies equally to a system in which these charges are reversed.

In the examples of FIG. 2A, the photoconductive layer 120 comprises a charge generation layer 205 and a charge transfer layer 210. In certain examples, in a print routine, the surface of the photoconductive layer 120 is initially charged with negative charges 215 by a charge roller, which may for example be the first or second refresh unit 110, 115. In some examples, a latent image is then formed by area-selective laser exposure 220. The laser exposure causes formation of electron-hole pairs 225 in the charge generation layer 205.

In the examples of FIG. 2B, the electrons combine with positive charges 230 from ground at the base of the charge generation layer 205, and the holes drift 235 through the charge transport layer 210 to the surface of the photoconductive layer 120, where they recombine with electrons 215. Surface negative charges 215 are thus discharged by laser exposure, forming the latent image to which charged toner particles are applied.

In the examples of FIG. 2C, one or more print routines cause build-up of contamination 240 at the surface of the photoconductive layer 120. In some examples, the contamination 240 comprises polymerisation of printing fluid, such as ink, or toner components by plasma radiation at a charge roller. In certain examples, the contamination layer 240 prevents electron-hole recombination at the surface of the photoconductive layer 120, and thus electron-hole pairs accumulate at the surface. As a result, holes 245 drifting to the surface are blocked by trapped holes 250. The holes 245 are thus loosely bound to surface electrons 215 and therefore spread laterally. This phenomenon, of lateral conductivity of holes, is distinct from lateral conductivity of electrons. The phenomenon may for example start when the trapped charge reaches around 75 milli-Coulombs.

This spread of charges may reduce physical dot size in an image and thus cause undesirable fading of images. As a consequence of non-uniform wear of a cleaning blade in the image forming apparatus 100, the contamination may cause a pattern of streaks in an image produced by the image forming device, the streaks typically being oriented in a direction of motion of the photoconductive layer. This phenomenon may be termed "old photoconductor syndrome".

Figure 2D:
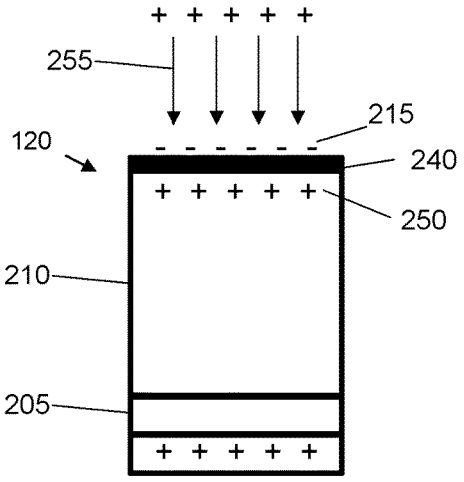
Figure 2E:
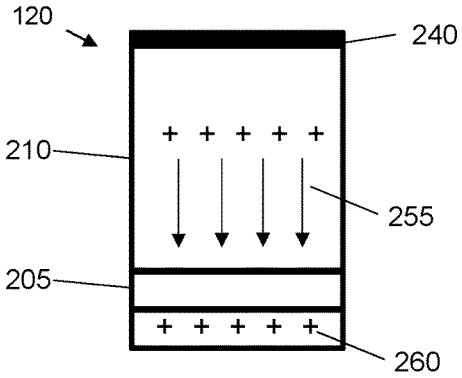

FIGS. 2D and 2E show a schematic representation of charge dynamics in the contaminated photoconductive layer 120 during a refreshing cycle, for example the first or second refreshing cycles as described above. Although examples of positive and negative charges are used, it will be appreciated that the description applies equally to a system in which these charges are reversed.

With reference to FIG. 2D, accumulated electron-hole 215, 250 pairs are removed by annihilating electrons 215 by deposition 255 of new positive charges. The deposition is caused by the application of the first, second or third refresh voltages to the photoconductive layer 120 from the first and/or second refresh units 110, 115. Incident positive charges annihilate electrons 215 and thus free trapped holes 250. Given sufficient charging time and voltage, a significant fraction of the trapped holes may be liberated.

FIG. 2E is a schematic representation of charge dynamics in the contaminated photoconductive layer 120 following deposition of new positive charges. The freed holes return 255 to ground 260. Although the contamination layer 340 is present, no trapped electron-hole pairs exist to cause lateral conductivity. As such, image quality is significantly improved and the photoconductive layer 120 may be said to have been refreshed. This significantly extends the effective lifespan of the photoconductive layer 120.

Figure 3:
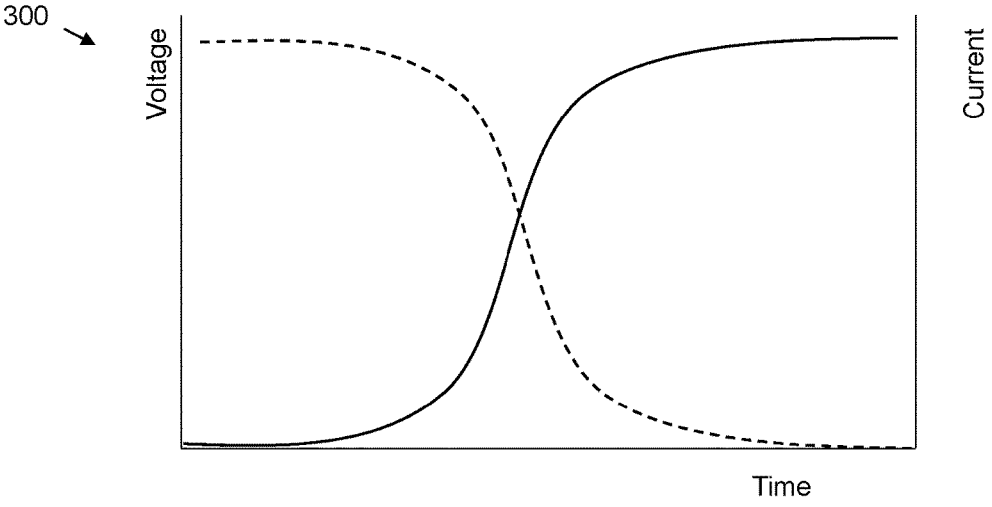
FIG. 3 is a graph of voltage and current in a photoconductive layer during a refresh cycle, as a function of time.

FIG. 3 shows a schematic representation of a graph 300 of voltage (dashed line) measured across the photoconductive layer 120 and current (solid line) measured through the photoconductive layer 120 during a refresh cycle, as a function of time. During such a refresh cycle, a constant voltage, for example 1500 volts, is applied. In such an example, the voltage measured across the photoconductive layer 120 may for example reduce from around 950 volts to around 50 volts, and the current measured through the photoconductive layer 120 may increase from around 0 milli-amps to around 0.8 milli-amps. Such a cycle may take around 200 seconds to complete, during which around 150 milli-Coulombs of positive charge may be applied. This measured applied charge indicates the number of electron-hole pairs liberated during a refreshing cycle. During the initial stage of a refreshing cycle, the photoconductive layer 120 behaves approximately as a resistor. Near the end of a refreshing cycle, the photoconductive layer behaves approximately as a capacitor. This behaviour occurs as a result of trapped electron-hole pairs acting as conducting charges until they are liberated.

Figure 4A:
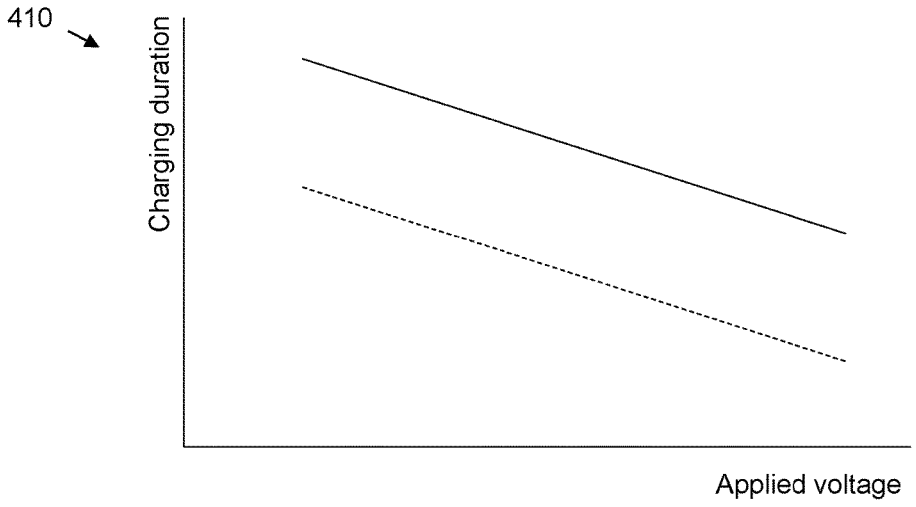
FIGS. 4A and 4B are graphs of charging duration of a refresh cycle as a function of voltage and as a function of drum rotation speed respectively.
Figure 4B:
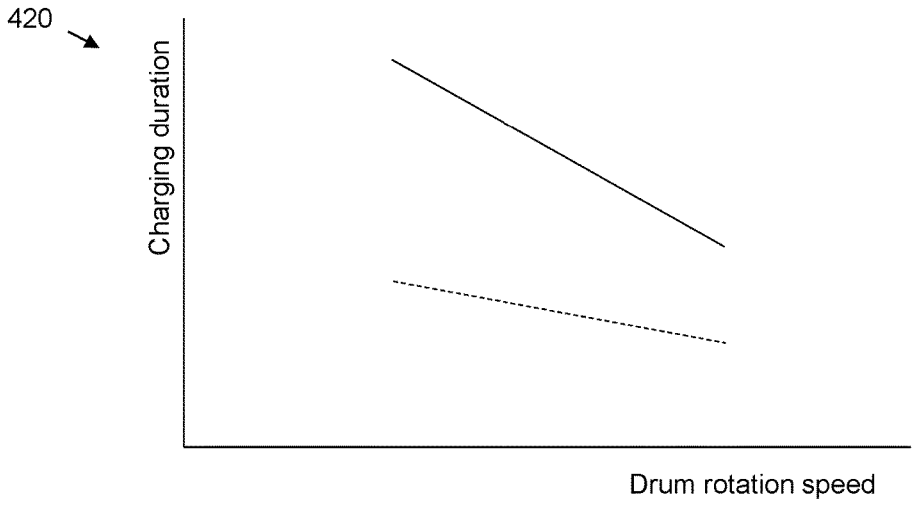

When a first refresh unit 110 and second refresh unit 115 apply first and second refresh voltages, respectively, to the photoconductive layer 120, the rate at which trapped electron-hole pairs are liberated is higher than when a single refresh unit applies either of the first or second refresh voltages. As such, the use of two refresh units during the first refreshing cycle allows the refreshing cycle to be more rapidly completed. This is illustrated in FIGS. 4A and 4B, which show schematic representations of a graph 410 of charging duration as a function of applied voltage, and a graph 420 of charging duration as a function of drum rotation speed respectively, where the photoconductive unit 105 is a photoconductive drum. The graphs 410, 420 show results for a single refresh unit (solid line) and for two refresh units (dashed line). As shown, charging duration reduces with increasing applied voltage, with increasing drum rotation speed, and with an increased number of refresh units. For example, where a single refresh unit is used with a voltage of 1000 volts, a five minute refresh cycle may be performed. However, with a first refresh unit 110 with a voltage of 1000 V and a second refresh unit 115 with a voltage of 950 volts, a two minute refresh cycle may be performed. A cause of this effect is that a higher voltage leads to more positive charges being available for liberation of electron-hole pairs. As another example, a 33% increase in drum rotation speed may allow a 20% decrease in charging duration when using a single refresh unit, and a 10% decrease in charging duration when using two refresh units.

The binding energy of trapped electron-hole pairs varies. In certain examples, a higher refresh voltage is applied to liberate more strongly trapped pairs. As described above, in certain examples, during the second refreshing cycle, the first refresh unit 110 applies a third voltage to the photoconductive layer 120; in such examples, the third voltage is higher than the first and second voltages applied during the first refreshing cycle. As such, the first refreshing cycle rapidly liberates more weakly trapped electron-hole pairs, and the second refreshing cycle liberates pairs too strongly trapped to be liberated during the first refreshing cycle.

Figure 5A:
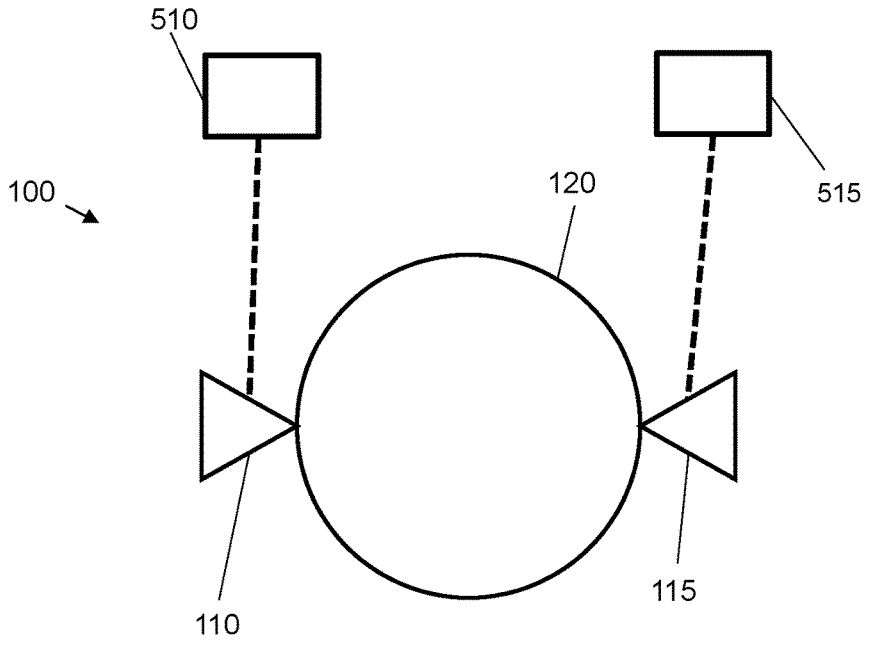
FIGS. 5A and 5B show configurations of power supply to refresh units according to examples.
Figure 5B:
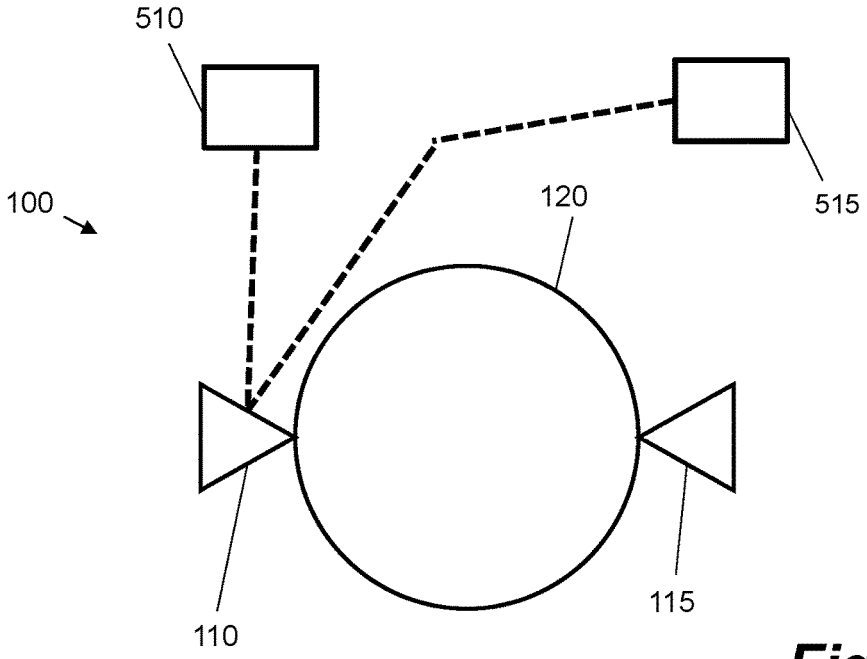

FIGS. 5A and 5B show configurations of power supply to the refresh units 110, 115 according to certain examples. In the examples of FIG. 5A, the image forming apparatus 100 comprises a first power unit 510 controllable by the controller 117 to supply power to the first refresh unit 110, and a second power unit 515 controllable by the controller 117 to supply power to the second refresh unit 115.

In an example the second power unit 515 is controllable by the controller 117 to supply power to the second refresh unit 115 for at least part of the first refreshing cycle. For at least part of the second refreshing cycle, the second power unit 515 is controllable by the controller 117 to supply power to the first refresh unit 110, as shown in FIG. 5B. This allows the third refresh voltage to be higher than either of the first and second refresh voltages. In certain examples, the first power unit 510 supplies sufficient power such that for the first refreshing cycle, the first refresh unit 110 applies 1000 volts to the photoconductive layer. Similarly, In certain examples, the second power unit 515 supplies sufficient power such that for the first refreshing cycle, the second refresh unit 115 applies 1100 volts to the photoconductive layer. In certain examples, the combined power of the first and second power units 510, 515 is then sufficient to allow the first refresh unit 110 to, during the second refreshing cycle, supply 2100 volts to the photoconductive layer 120.

The voltages given here are illustrative examples. For example, the first and second refresh voltages may be equal, or either one may be higher than the other. The third refresh voltage may equal the sum of the first and second refresh voltages, as described here, or may be higher or lower than the sum of the first and second refresh voltages.

In other examples, the image forming apparatus 100 comprises a power supply controllable by the controller 117 to supply power to the first and second power units for at least part of the first refreshing cycle, and to supply power to the first refresh unit for at least part of the second refreshing cycle.

Figure 6:
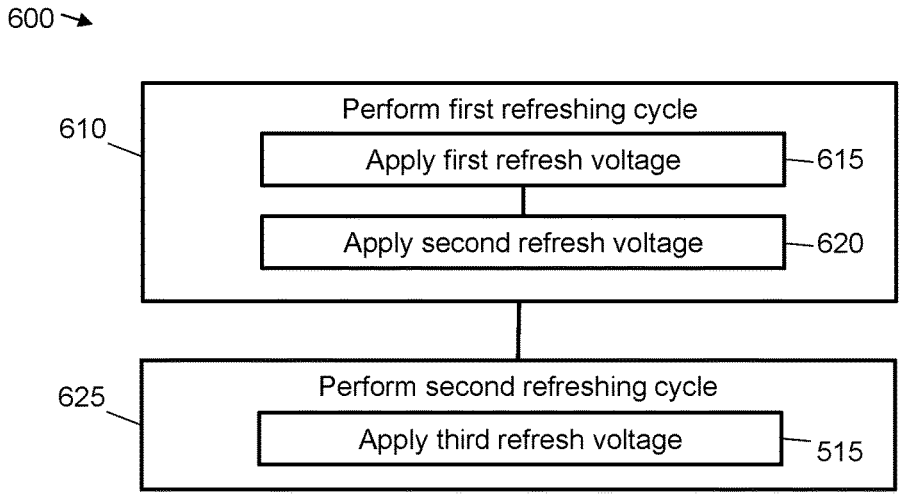
FIG. 6 is a flow diagram depicting a method for refreshing a photoconductive layer according to an example.

FIG. 6 is a flow diagram depicting an example method for refreshing a photoconductive layer 120. At block 610 a first refreshing cycle is performed. The first refreshing cycle comprises applying 615, at a first refresh unit 110, a first refresh voltage to the photoconductive layer 120 and comprises applying 620, at a second refresh unit 115, a second refresh voltage to the photoconductive layer 120. In some examples, the first and second voltages are applied simultaneously. In other examples, application of the first and second voltages is not simultaneous but overlaps in time.

At block 625 a second refreshing cycle is performed. The second refreshing cycle comprises applying 630, at the first refresh unit 110, a third refresh voltage to the photoconductive layer 120. The third refresh voltage is higher than the first refresh voltage and higher than the second refresh voltage. In certain examples, the third voltage equals a sum of the first and second voltages.

Similarly to examples described above, each of the first and second refreshing cycles electrically bias the photoconductive layer 120 to a refresh polarity opposite to a print polarity applied during a print routine of the image forming apparatus 100.

According to some examples, at least one of the first, second and third refresh voltages increases with elapsed refreshing cycle time. This flattens the temporal variance of the current through the photoconductive layer 120 during a refreshing cycle, for example as shown in FIG. 3. This typically increases rate of liberation of electron-hole pairs.

In examples, the image forming apparatus 100 comprises a photoconductive drum where the photoconductive drum comprises the photoconductive layer 120. In some examples, during at least one of the first and second refreshing cycles, the photoconductive drum rotates at a predetermined rotation speed; in such examples the predetermined rotation speed comprises a maximum rotation speed sufficient for discharge of trapped charges in the photoconductive layer. As described above, increase in drum rotation speed allows a decrease in refreshing cycle duration. However, if rotation speed is increased above a certain threshold, further decrease in refreshing cycle duration is prevented as a consequence of the non-zero time required for the liberation of electron-hole pairs.

In other examples, the first refresh voltage is a maximum voltage available from the first refresh unit during the first refreshing cycle, the second refresh voltage is a maximum voltage available from the first refresh unit during the first refreshing cycle and the third refresh voltage is a maximum voltage available from the first refresh unit during the second refreshing cycle. As described above, the use of higher refresh voltages allows a lower charging duration and also liberates more tightly bound electron-hole pairs. The use of maximum available voltages maximises this effect, provided the voltages are not so high as to cause breakdown of the photoconductive layer 120. Such breakdown may for example occur at voltages of around 150 volts per micrometer.

As described above, in certain examples the first refresh unit 110 comprises a charge roller and the second refresh unit 115 comprises an intermediate transfer drum, or alternatively the first refresh unit 110 comprises an intermediate transfer drum and the second refresh unit 115 comprises a charge roller. In another example, the first and second refresh units 110, 115 both comprise charge rollers, or both comprise intermediate transfer drums.

In certain examples, the first refreshing cycle is performed during a first time period and the second refreshing cycle is performed during a second, different time period. In certain examples, the second time period begins after the end of the first time period. In some examples, the first refreshing cycle is performed during a time period that is not associated with a print routine, for example an idle state. In some examples, the second refreshing cycle is performed during the same idle state or during another idle state, for example during the next idle state.

Alternatively or additionally, in some examples the first and second refreshing cycles are performed after the image forming apparatus has produced a predetermined number of impressions since last performing the first and second refreshing cycles, as trapped electron-hole pairs build up with each impression. In an example, the first and second refreshing cycles are performed after every few thousand impressions. Where the image forming apparatus 100 comprises a Hewlett Packard Indigo™ digital press, with repeated application of refreshing cycles as described above, the lifetime of the photoconductor may be increased from around 100000 to around 300000 impressions.

Figure 7:
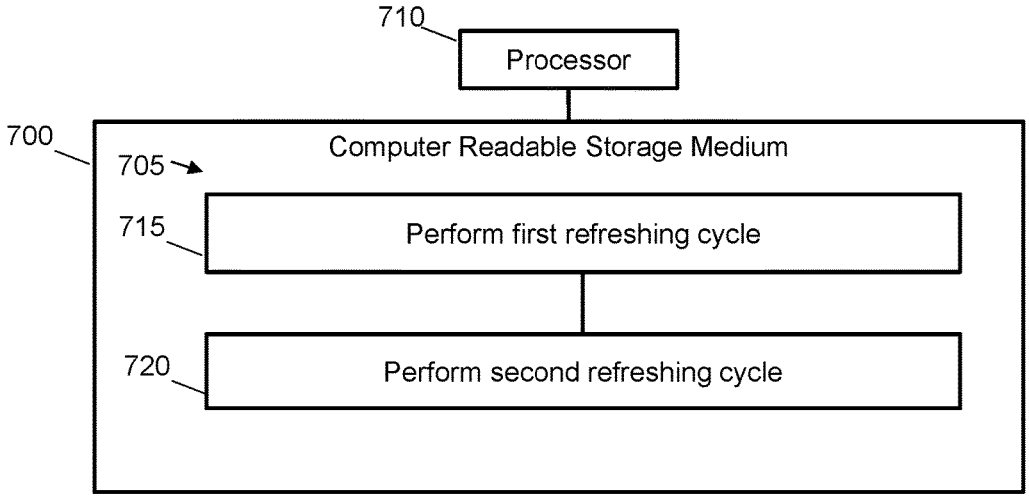
FIG. 7 shows an example of a non-transitory computer-readable storage medium according to an example.

FIG. 7 shows an example of a non-transitory computer-readable storage medium 700 comprising a set of computer readable instructions 705 which, when executed by at least one processor 710, cause the processor 710 to perform a method according to examples described herein. The computer readable instructions 705 may be retrieved from a machine-readable media, e.g. any media that can contain, store, or maintain programs and data for use by or in connection with an instruction execution system. In this case, machine-readable media can comprise any one of many physical media such as, for example, electronic, magnetic, optical, electromagnetic, or semiconductor media. More specific examples of suitable machine-readable media include, but are not limited to, a hard drive, a random access memory (RAM), a read-only memory (ROM), an erasable programmable read-only memory, or a portable disc.

In an example, instructions 705 cause the processor 710 to, at block 715, perform a first refreshing cycle. The first refreshing cycle comprises applying, at a charge roller, a first fresh voltage to a photoconductive layer 120 and applying, at an intermediate transfer member such as an intermediate transfer drum, a second refresh voltage to the photoconductive layer 120.

At block 720 the instructions 705 cause the processor 710, after completion of the first refreshing cycle, to perform a second refreshing cycle. The second refreshing cycle comprises applying, at the charge roller, a third refresh voltage to the photoconductive layer 120. In other examples, the second refreshing cycle comprises applying the third refresh voltage at the intermediate transfer drum. The third refresh voltage is equal to a sum of the first refresh voltage and the second refresh voltage.

Each of the first and second refreshing cycles electrically bias the photoconductive layer to a refresh polarity opposite to a print polarity applied during a print routine of an image forming apparatus 100.

The preceding description has been presented to illustrate and describe examples of the principles described. This description is not intended to be exhaustive or to limit these principles to any precise form disclosed. Many modifications and variations are possible in light of the above teaching. For example, although FIGS. 6 and 7 depict the first refreshing cycle before the second refreshing cycle, in examples the second refreshing cycle may be performed first. It is to be understood that any feature described in relation to any one example may be used alone, or in combination with other features described, and may also be used in combination with any features of any other of the examples, or any combination of any other of the examples.

What is claimed is:

1. An image forming apparatus comprising:

a photoconductive unit comprising a photoconductive layer;

a first refresh unit;

a second refresh unit; and a controller, wherein:

the first refresh unit is controllable by the controller to, during a first refreshing cycle, apply a first refresh voltage to the photoconductive layer;

the second refresh unit is controllable by the controller to, during the first refreshing cycle, apply a second refresh voltage to the photoconductive layer; and the first refresh unit is controllable by the controller to, during a second refreshing cycle, apply a third refresh voltage to the photoconductive layer, wherein the third refresh voltage is higher than the first refresh voltage and higher than the second refresh voltage, and wherein:

at least one of the first and second refresh units is controllable by the controller to, during a print routine, electrically bias the photoconductive layer to a print polarity;

each of the first and second refresh units are controllable by the controller to, during the first refreshing cycle, electrically bias the photoconductive layer to a refresh polarity opposite to the print polarity; and the first refresh unit is controllable by the controller to, during the second refreshing cycle, electrically bias the photoconductive layer to the refresh polarity.

2. The image forming apparatus of claim 1, comprising:

a first power unit controllable by the controller to supply power to the first refresh unit, and a second power unit controllable by the controller to supply power to the second refresh unit.

3. The image forming apparatus of claim 2, wherein the second power unit is controllable by the controller to:

supply power to the second refresh unit for at least part of the first refreshing cycle; and supply power to the first refresh unit for at least part of the second refreshing cycle.

4. The image forming apparatus of claim 2 comprising a power supply controllable by the controller to:

supply power to the first and second power units for at least part of the first refreshing cycle, and supply power to the first refresh unit for at least part of the second refreshing cycle.

5. A method for refreshing a photoconductive layer in an image forming apparatus, the method comprising:

performing a first refreshing cycle comprising:

applying, at a first refresh unit, a first refresh voltage to the photoconductive layer; and applying, at a second refresh unit, a second refresh voltage to the photoconductive layer; and performing a second refreshing cycle comprising:

applying, at the first refresh unit, a third refresh voltage to the photoconductive layer, the third refresh voltage being higher than the first refresh voltage and higher than the second refresh voltage, wherein each of the first and second refreshing cycles electrically bias the photoconductive layer to a refresh polarity opposite to a print polarity applied during a print routine of the image forming apparatus.

6. The method of claim 5, wherein the third voltage is equal to a sum of the first and second voltages.

7. The method of claim 5 wherein at least one of the first, second and third refresh voltages increases with elapsed refreshing cycle time.

8. The method of claim 5, wherein:

the image forming apparatus comprises a photoconductive drum;

the photoconductive drum comprises the photoconductive layer; and during at least one of the first and second refreshing cycles, the photoconductive drum rotates at a predetermined rotation speed, the predetermined rotation speed being a maximum rotation speed sufficient for discharge of trapped charges in the photoconductive layer.

9. The method of claim 5, wherein:

the first refresh voltage is a maximum voltage available from the first refresh unit during the first refreshing cycle;

the second refresh voltage is a maximum voltage available from the first refresh unit during the first refreshing cycle; and/or the third refresh voltage is a maximum voltage available from the first refresh unit during the second refreshing cycle.

10. The method of claim 5, wherein:

the first refresh unit comprises a charge roller and the second refresh unit comprises an intermediate transfer drum, or the first refresh unit comprises an intermediate transfer drum and the second refresh unit comprises a charge roller.

11. The method of claim 5, comprising performing the first refreshing cycle during a first time period and performing the second refreshing cycle during a second, different time period.

12. The method of claim 11, wherein the second time period begins after the end of the first time period.

13. The method of claim 5, comprising performing the first and second refreshing cycles during a time period that is not associated with a print routine of the image forming apparatus.

14. The method of claim 5, comprising performing the first and second refreshing cycles after the image forming apparatus has produced a predetermined number of impressions since last performing the first and second refreshing cycles.

15. A non-transitory computer-readable storage medium comprising a set of computer-readable instructions stored thereon which, when executed by at least one processor, cause the at least one processor to:

perform a first refreshing cycle comprising:

applying, at a charge roller, a first refresh voltage to a photoconductive layer; and applying, at an intermediate transfer member, a second refresh voltage to the photoconductive layer; and after completion of the first refreshing cycle, perform a second refreshing cycle comprising:

applying, at the charge roller, a third refresh voltage to the photoconductive layer, the third refresh voltage being equal to a sum of the first refresh voltage and the second refresh voltage, wherein each of the first and second refreshing cycles electrically bias the photoconductive layer to a refresh polarity opposite to a print polarity applied during a print routine of an image forming apparatus.

* * * * *